US007539451B2

(12) United States Patent
Kawasumi et al.

(10) Patent No.: US 7,539,451 B2
(45) Date of Patent: May 26, 2009

(54) IMAGE FORMING APPARATUS AND TONER

(75) Inventors: Masanori Kawasumi, Yokohama (JP); Haruji Mizuishi, Oota-ku (JP); Tokuya Ojimi, Kawasaki (JP); Toshio Koike, Kawasaki (JP); Takeshi Shintani, Kawasaki (JP); Yuji Arai, Kawasaki (JP); Tazuki Yoneda, Oota-ku (JP); Ken Amemiya, Nerima-ku (JP); Takaaki Tawada, Yokohama (JP); Masami Tomita, Numazu (JP); Takeshi Uchitani, Kamakura (JP); Nobuo Kuwahara, Yokohama (JP); Hiroyuki Nagashima, Yokohama (JP); Masato Yanagida, Meguro-ku (JP)

(73) Assignee: Ricoh Company Ltd., Tokyo (JP)

( * ) Notice: Subject to any disclaimer, the term of this patent is extended or adjusted under 35 U.S.C. 154(b) by 250 days.

(21) Appl. No.: 11/223,923

(22) Filed: Sep. 13, 2005

(65) Prior Publication Data

US 2006/0062594 A1 Mar. 23, 2006

(30) Foreign Application Priority Data

Sep. 17, 2004 (JP) ..... 2004-271917
Nov. 19, 2004 (JP) ..... 2004-335310

(51) Int. Cl.
*G03G 21/00* (2006.01)

(52) U.S. Cl. ..... 399/343

(58) Field of Classification Search ..... 399/343
See application file for complete search history.

(56) References Cited

U.S. PATENT DOCUMENTS 5,328,795 A * 7/1994 Yamashiro et al. ..... 430/137.19

(Continued)

FOREIGN PATENT DOCUMENTS

JP 3-240076 10/1991

(Continued)

OTHER PUBLICATIONS

U.S. Appl. No. 11/517,390, filed Sep. 8, 2006, Shimojo et al.

(Continued)

*Primary Examiner*—David M Gray
*Assistant Examiner*—Bryan Ready
(74) *Attorney, Agent, or Firm*—Oblon, Spivak, McClelland, Maier & Neustadt, P.C.

(57) ABSTRACT

An image forming apparatus having an image support body configured to support a latent image, a charging member configured to provide a substantially uniform charge to a surface of the image support body and a spacer coupled to the charging member and configured to contact the image support body to maintain a gap between the image support body and the charging member. A cleaning part is configured to clean the surface of the image support body after developer is applied to the image support body and transferred to a recording medium. The cleaning part is configured to satisfy the relationship A+B≦C, where A is a width of the effective charging area of the charging member that charges a surface of the image support body, B is a total width of the spacer that contacts the image support body, and C is a width of cleaning part that contacts the image support body.

10 Claims, 6 Drawing Sheets

U.S. PATENT DOCUMENTS

| | | | | |
|---|---|---|---|---|
| 6,470,161 | B2 * | 10/2002 | Fujishiro et al. | 399/159 |
| 2002/0172880 | A1 * | 11/2002 | Takayanagi et al. | 430/108.23 |
| 2003/0049555 | A1 * | 3/2003 | Sakon et al. | 430/124 |
| 2003/0138717 | A1 * | 7/2003 | Yagi et al. | 430/110.4 |
| 2003/0152859 | A1 * | 8/2003 | Emoto et al. | 430/109.4 |
| 2006/0062594 | A1 | 3/2006 | Kawasumi et al. | |

FOREIGN PATENT DOCUMENTS

| | | |
|---|---|---|
| JP | 2001-350321 | 12/2001 |

OTHER PUBLICATIONS

U.S. Appl. No. 11/512,385, filed Aug. 30, 2006, Tomita.
U,S. Appl. No. 11/736,881, filed Apr. 18, 2007, Hosokawa et al.
U.S. Appl. No. 11/943,713, filed Nov. 21, 2007, Ishikawa et al.
U.S. Appl. No. 12/167,564, filed Jul. 3, 2008, Hatori et al.
U.S. Appl. No. 12/246,027, filed Oct. 6, 2008, Uno et al.
U.S. Appl. No. 12/253,538, filed Oct. 17, 2008, Uno et al.

* cited by examiner

IMAGE FORMING APPARATUS AND TONER

CROSS-REFERENCE TO RELATED APPLICATIONS:

This document claims priority and contains subject matter related to Japanese Patent Applications Nos. 2004-271917 and 2004-335310, filed on Sep. 17, 2004 and on Nov. 19, 2004 respectively, the entire contents of each of which are hereby incorporated herein by reference.

Field of the Invention

The present invention relates to an electrophotographic image forming apparatus such as a copier, a printer, or a facsimile. In addition, the present invention also relates to an image forming apparatus using a non-contact charging device, and a toner used in the image forming apparatus.

BACKGROUND OF THE INVENTION

Discussion of Background

In an electrophotographic image forming apparatus such as a copier, a printer, or a facsimile, a photoconductor is uniformly electrified or charged by various methods before forming an electrostatic latent image on the surface of the photoconductor. Recently, a charging roller with an electroconductive member contacting a surface of photoconductor is put into practice as one of the methods of electricity charging. This method can realize low ozonization and low power because electrifying of the surface of photoconductor is provided by applying the voltage between the charge roller and photoconductor when in contact state.

However, the charge roller used in such a contact charging device is provided with a roller member formed of an electroconductive rubber layer formed on the outside of a metal core. Thus, when the charging roller is left in the state that it is pushed against the surface of photoconductor for a long term, a material (for example, plasticizer) included in the charging roller releases from the surface of the charging roller, and it pollutes the surface of photoconductor. In addition, as charging with electricity is performed in the state that the charging member (such as charge roller) contacts the surface of the image bearing member (such as photoconductor), the residual toner, which remains after the image transferring, on the surface of the image bearing member is transferred to the surface of the charging member and induces pollution on the surface of the charging member.

Japanese Patent Laid-Open No. 03-240076 discloses a non-contact charging device, in which a spacer or tape with a predetermined thickness is attached to opposing ends of an elasticity roller part of a charging roller as a gap control material. With this configuration the gap control material at the ends of the charging roller is in contact with the photoconductor such that other areas of the charging roller have a predetermined gap distance from the surface of the photoconductor. According to this non-contact charging device, because an imaging effective area, which is inside of the gap control materials on the ends of the charging roller, does not come in contact with the surface of photoconductor and adhesion of the material included in the elasticity charging roller to the surface of photoconductor can be reduced. Moreover, transferring of encrustations, such as residual toner bonded to the surface of photoconductor, to the surface of the charging roller can be reduced.

Japanese Patent Laid-Open No. 2001-350321 also discloses a non-contact charging device, in which tape spacers on the charging roller contact a coated surface of photoconductor to form a gap between the surface of the photoconductor and the surface of the charging roller. Because the hardness of coated portion is less than that of non-coated portion, when the tape is disposed opposite to the coated portion of photoconductor, an abrasion and wound of the tape member is reduced.

However, the present inventors have recognized that in the non-contact charging devices of the above-noted Japanese patents, as the charging roller is disposed opposite to the photoconductor, the toner or carrier bonds to the gap control materials (for example, tape). This is particularly true of small sized developer, which is typically used to provide good image resolution. This toner and/or carrier bonding to the gap tape causes an abnormal picture due to periodic gap changes that cause a changing electric charging current. In addition, the toner and/or carrier bonding to the tape spacers causes an increase in quantity of ozonea, and may cause damage to the photoconductor.

SUMMARY OF THE INVENTION

It is a general object of the present invention to provide an image forming apparatus in which one or more of the above-mentioned problems are addressed.

A first more specific object of the present invention is to provide an improved image forming apparatus that can reduce the amount of toner and/or carrier adhering to gap control materials.

A second more specific object of the present invention is to provide an improved image forming apparatus that can substantially maintain a precise gap between the charging roller and photoconductor and print high-quality pictures over a long term.

A third more specific object of the present invention is to provide toner preferably used for a non-contact image forming apparatus.

To achieve the above-mentioned and/or other objects, there is provided according to one non-limiting aspect of the present invention an image forming apparatus having an image support body configured to support a latent image, a charging member configured to provide a substantially uniform charge to a surface of the image support body and a spacer coupled to the charging member and configured to contact the image support body to maintain a gap between the image support body and the charging member. Also included is an exposing part configured to expose the electrified surface of the image support body to write the latent image based on image data, a developing part configured to develop the latent image by supplying toner particles to the latent image formed on the surface of the image support body to make the latent image a visible image and a transferring part configured to transfer the visible image on the surface of the image support body onto a transferring medium. A cleaning part is configured to clean the surface of the image support body after the transferring, the cleaning part being configured to satisfy the relationship $A+B \leqq C$, where A is a width of the effective charging area of the charging member that charges a surface of the image support body, B is a total width of the spacer that contacts the image support body, and C is a width of cleaning part that contacts the image support body.

Additionally, there is provided according to another non-limiting aspect of the invention toner for a development of an electrophotography process of an image forming apparatus including the above-mentioned image forming apparatus, wherein each particle of the toner has an average roundness greater than or equal to 0.93 and smaller than or equal to 1.0.

According to benefits realized by the present invention, it is possible to provide an image forming apparatus that can substantially maintain a precise gap and print the high-quality pictures in the long term even if polymerization toner is used.

Other aspects of the invention, as well as objects, features and advantages of the present invention will become more apparent from the following detailed description when read in conjunction with the accompanying drawings.

DETAILED DESCRIPTION OF THE PREFERRED EMBODIMENTS

Embodiments of the invention are explained below based on the drawings. However, the present invention is not limited to the specifically disclosed embodiments, and variations and modifications may be made without departing from the scope of the present invention.

Figure 1:
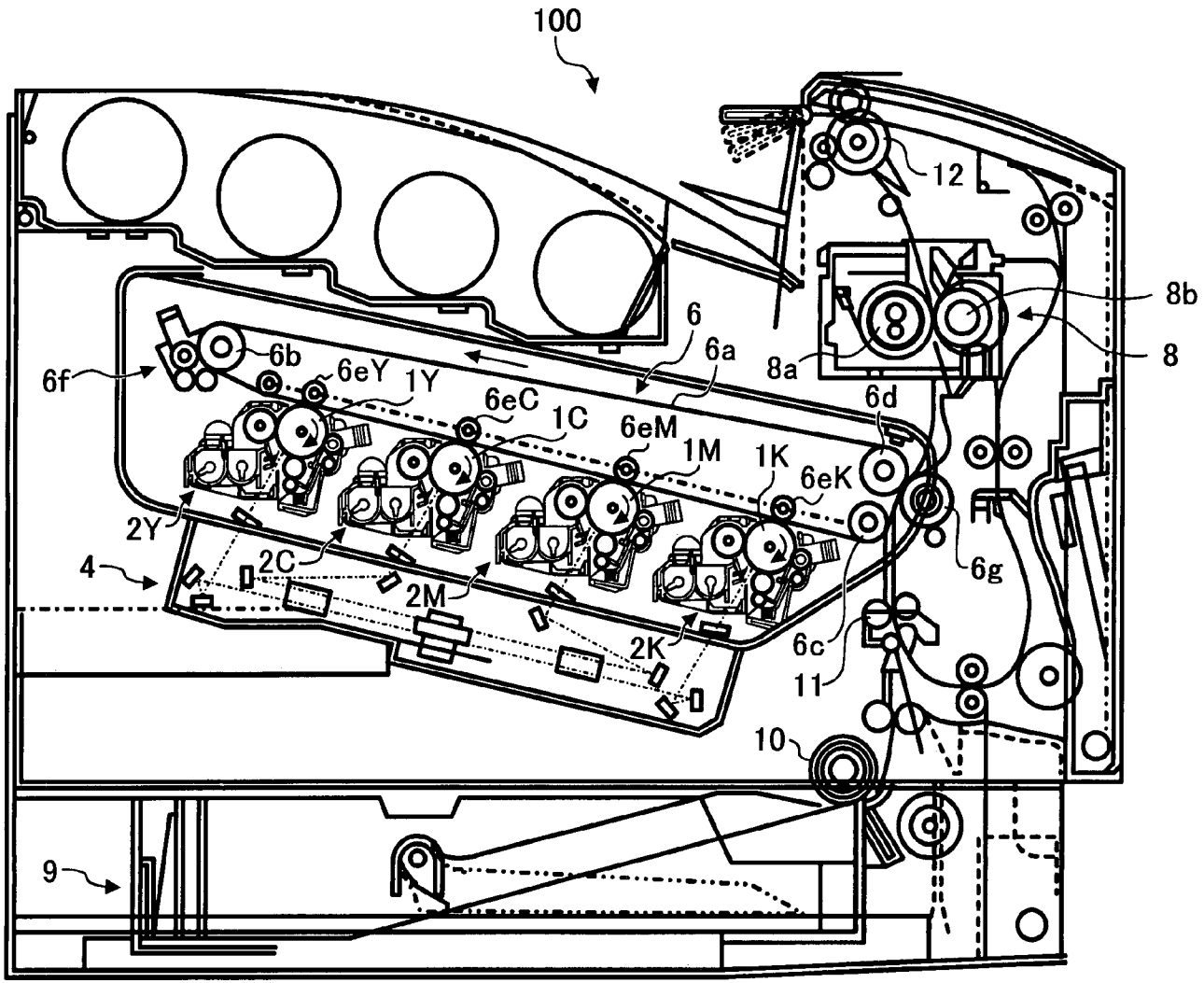
FIG. 1 shows an exemplary structure of an image forming apparatus according to an embodiment of the present invention.

FIG. 1 is an elevation view showing an image forming apparatus 100 according to an embodiment of the present invention. Preferably, the image forming apparatus 100 uses electrophotography. The image forming apparatus 100 is referred to as "tandem image forming apparatus" and forms color images by using four color toners. The four color toners are yellow, cyan, magenta and black (hereinafter referred to as Y, C, M and K, respectively). This image forming apparatus 100 has four photoconductors 1Y, 1C, 1M and 1K as the latent image bearing members which are contained in image forming units 2Y, 2C, 2M and 2K, respectively. In this embodiment, the photoconductor 1 including a photoconductive drum is used, but a photoconductor including a belt can be used. Each photoconductor 1Y; 1C, 1M and 1K rotates in the direction indicated by the arrow illustrated in FIG. 1 while each photoconductor contacts an intermediary transfer belt 6 A serving as a surface movable member.

As seen in FIG. 1, the intermediary transfer belt 6A (i.e., an endless belt), which is included in a transfer device 6, is stretched onto three supporting rollers 6B, 6C and 6D and moves in the direction indicated by the arrow illustrated in the figure. On the intermediary belt 6A, the toner images on each photoconductor 1Y, 1C, 1M and 1K are transferred on each other by an electrostatic transfer method, as is known in the art. A transfer charger can be used in the electrostatic transfer method, but a first transfer roller 6E that can restrain the amount of dust generated at the time of transfer, is used in this embodiment.

Specifically, on the back of each portion of the intermediary transfer belt 6A which contacts each photoconductor 1Y, 1C, 1M and 1K, first transfer rollers 6EY, 6EC, 6EM and 6EK are placed as a transfer device 6. A first transfer area is formed between a portion of the intermediary transfer belt 6A pressed by the first transfer roller 6E and the photoconductor 1. When each toner image on each photoconductor 1Y, 1C, 1M and 1K is transferred to the intermediary transfer belt 6A, a positive bias is applied to the first transfer roller 6E. Thereby, a transfer electric field is formed in the area (hereinafter referred to as transfer area) where each first transfer is performed. Therefore, the toner images on each photoconductor 1Y, 1C, 1M and 1K are electrostatically attached and thus transferred to the intermediary transfer belt 6A.

A belt cleaning device 6F configured to remove toners remaining on the surface of the intermediary transfer belt 6A is provided adjacent the intermediary belt 6A. The belt cleaning device 6F collects extraneous toners disposed on the surface of the intermediary transfer belt 6A with a fur brush and a cleaning blade, for example. The extraneous toner is transferred from the belt cleaning device 6F to a waste toner bottle (not shown) by a transfer means or unit (not shown). The intermediary transfer belt 6A can be an endless single layer belt having a volume resistance of from $10^9$ to $10^{11}$ Ω·CM and is preferably made of polyvinylidene fluoride (PVDF). Also multiple resin layers including an elastic layer can be used.

In addition, a second transfer roller 6G is provided so as to be brought into contact with the portion of the intermediary transfer belt 6A that is stretched on the supporting roller 6D. A second transfer area is formed between this intermediary belt 6A and the second transfer roller 6G. A transfer paper serving as a recording material is fed to this second transfer area according to a predetermined timing. This transfer paper is set in a paper feeder cassette 9 located below the irradiating device 4 as illustrated in FIG. 1, and transferred to the second transfer area by a pickup roller 10, a pair of register rollers 11, etc.

The overlaid toner image on the intermediary transfer belt 6A is transferred to the transfer paper altogether at the second transfer area. At the time of this second transfer, a positive bias is applied to the second transfer roller 6G to form a transfer electric field and thereby the toner image on the intermediary transfer belt 6A is transferred to the transfer paper.

Figure 2:
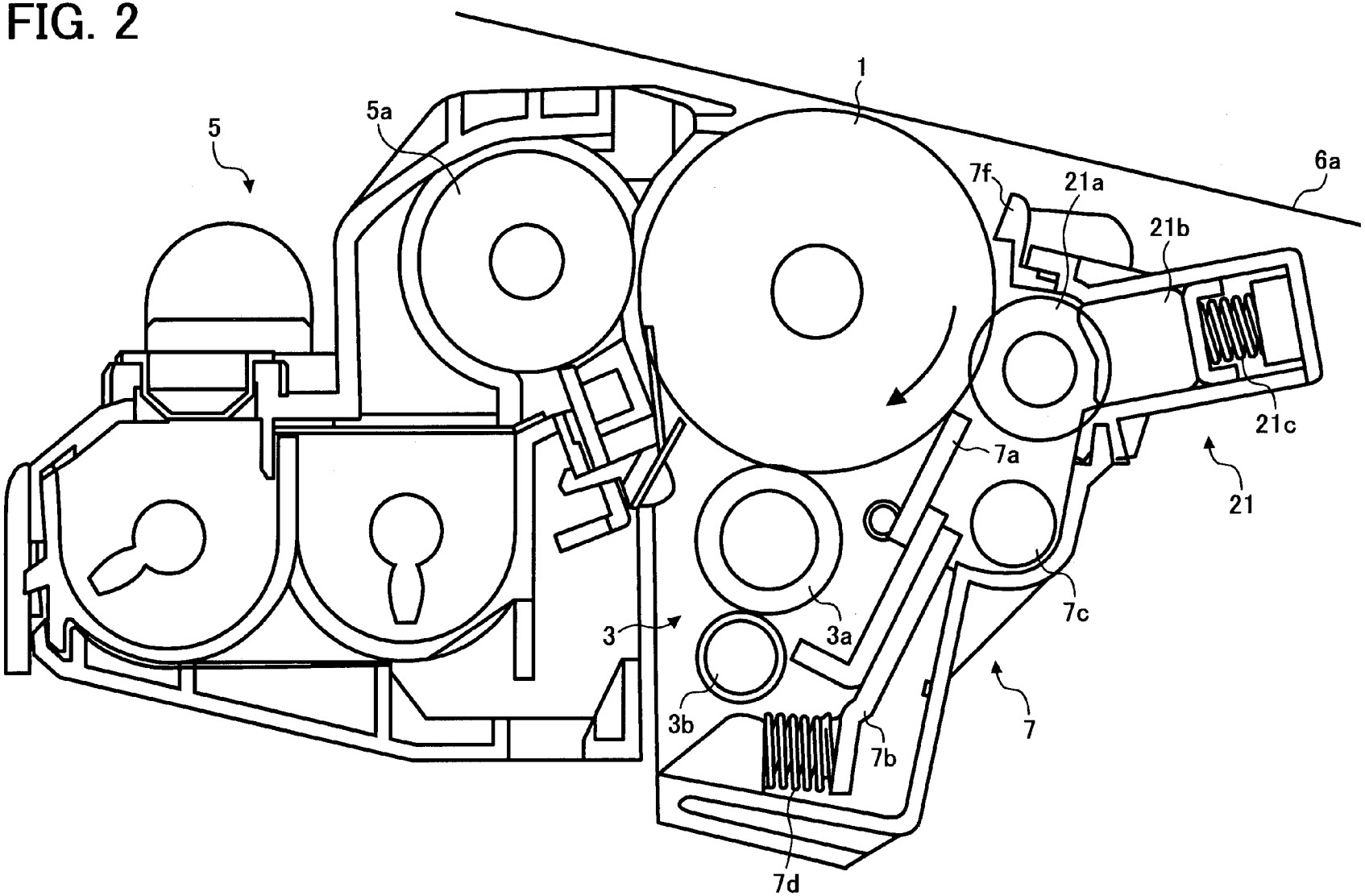
FIG. 2 is an enlarged view showing an image forming unit of the image forming apparatus shown in FIG. 1.

FIG. 2 is a detail view of the image forming unit 2 of the image forming apparatus 100, the image forming unit 2 including the photoconductor 1. The characters indicating color (Y, C, M and K) are omitted because arrangements of components around photoconductor 1Y, 1C, 1M and 1K contained in image forming unit 2Y, 2C, 2M and 2K, respectively, is similar. Thus, only one image forming unit 2 is representatively illustrated in FIG. 2. As seen in FIG. 2, the imaging forming unit includes a developing device 5 which includes a stirring convey screw (not shown) and a doctor blade (not shown) and which is configured to convert a latent image into a toner image, a pre-cleaning discharger (hereinafter referred to as PCL, which represents PreCleaningLamp) configured to discharge the charged electric potential of the photoconductor 1, a lubricant applicator 21 configured to apply a lubricant to the photoconductor 1, a cleaning device 7 for removing toner particles remaining on the photoconductor 1, and a charging device 3 configured to charge the photoconductor 1. These components are placed around the photoconductor 1 according to the moving direction of the surface of the photoconductor 1. This image forming unit 2 preferably can serve as a process cartridge.

The developing device 5 contains a developing roller 5A serving as a developer bearing member which is partially exposed from the opening of the casing of the developing device 5. The toner preferably used in this embodiment is a double component developer containing a toner and a carrier. However, a single component developer including no carrier can be also used. The developing device 5 contains toners therein, which are replenished from respective color toner bottles. The developing roller 5A contains a magnet roller for generating a magnetic field and a developing sleeve, which coaxially rotates around the magnet roller. The magnetic force generated by the magnet roller forms filaments of carriers contained in the developer on the developing roller 5A. The carrier filaments are transferred to an area (hereinafter referred to as developing area) where the developing roller 5A faces the photoconductor 1. The surface of the developing roller 5A and the surface of the photoconductor 1 move in the same direction at the developing area while the linear velocity of the former is relatively faster that the latter. At this point, a bias of −300 V is applied to the surface of the developing roller 5A by a power supply (not shown) to thereby form the developing electric field at the developing area. Thus, when the carrier filaments on the developing roller 5A abrade the surface of the photoconductor 1, the toner particles attached to the surface of the carrier are attracted to the surface of the photoconductor 1 to perform development.

The lubricant applying device 21 configured to apply a lubricant mainly contains a molded lubricant 21B set in a fixed case, a brush roller 21A located so as to contact the molded lubricant 21B for scraping and applying the lubricant, and a pressure spring 21C which compresses the molded lubricant 21B to the brush roller 21A. The molded lubricant 21B preferably has a rectangular solid form, and more preferably has a stick form. In addition the brush roller 21B extends in the axial direction of the photoconductor 1. Although the molded lubricant 21B is an expendable item and thus the thickness decreases with time, the pressure spring 21C applies a force to the molded lubricant 21B against the brush roller 21A; therefore the molded lubricant 21B is constantly pressed to contact the brush roller 21A. Thus, almost all of the molded lubricant 21B can be used.

The lubricant applying device 21 can be provided in the cleaning device 7 together with the cleaning blade 7A. In this case, toners remaining on the photoconductor 1 attach to the brush when the brush abrades the photoconductor 1. Then the toners attached to the brush are shaken off by a flicker and transferred to a collection and transfer means (not shown), or drop off for collection when the toners attached to the brush contact the molded lubricant 21B.

Specific preferred examples of lubricants include aliphatic fatty acid metal salts, silicone oils and fluorine-containing resins, which can be used alone or in combination with one another. Specific preferred examples of the fatty acids forming the fatty acid metal salts include straight chain hydrocarbons, such as myristic acid, palmitic acid, stearic acid and oleic acid. Specific preferred examples of the metals include lithium, magnesium, calcium, strontium, zinc, cadmium, aluminum, cerium, titan, and iron. Specific preferred examples of the fatty acid metal salts include zinc stearate, magnesium stearate, aluminum stearate and iron stearate.

The cleaning device 7 contains the cleaning blade 7A, a supporting member 7B, a toner collecting coil 7C and a blade pressure spring 7D. The cleaning blade 7A removes toners remaining on the photoconductor after image transfer. The cleaning blade 7A is provided to the cleaning device 7 by attaching the cleaning blade 7A to the supporting member 7B. The supporting member 7B has no specific preferred material and can be made of metals, plastics, ceramics, etc. The cleaning blade 7A can be made of an elastic substance having a low friction factor, for example, urethane resins, silicone resins and fluorine containing resins. Examples of preferred resins include urethane elastomers, silicone elastomers and fluorine elastomers. For the cleaning blade 7A, hot curing urethane resins are preferred. Urethane elastomers are preferred in terms of anti-abrasion, anti-ozone and anti-contamination. The elastomers mentioned above include rubber. The cleaning blade 7A also preferably has a degree of hardness of from 65 to 85 by JIS-A standard. The cleaning blade 7A preferably has a thickness of from 0.8 to 3.0 mm and a protrusion of from 3 to 15 mm. Further conditions such as contact pressure, contact angle, the amount of inroad can be optionally determined.

Figure 3:
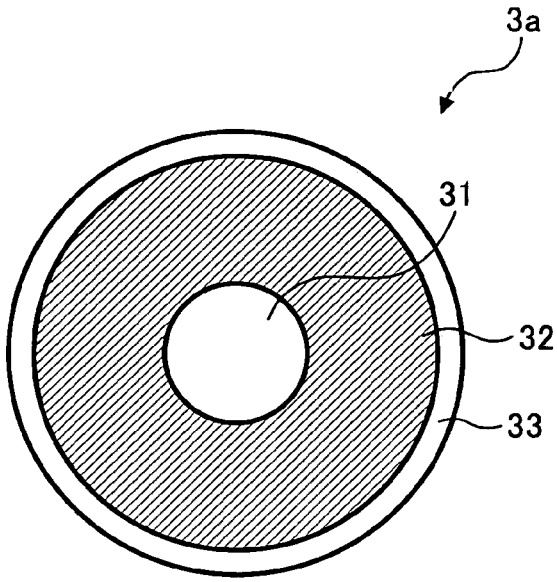
FIG. 3 is a cross section showing a constitution of a charging roller of the image forming apparatus shown in FIGS. 1 and 2.

As also seen in FIG. 2, the charging device 3 consists of a charging roller 3*a* (the charging member) disposed adjacent to the photoconductor 1, and a charging cleaning member 3*b* disposed so as to be in contact with a side of the contact roller opposite to the side where the charging roller 3*a* is adjacent to the photoconductor 1. FIG. 3 is a cross section of the charging roller 3*a*. The charging roller 3*a* has a metal core 31 (electroconductive support) that is cylindrical in shape, a resistance adjustment layer 32 formed in a substantially uniform thickness over the outer peripheral surface of the metal core 31, and a protective layer 33 that reduces leakage (as discussed below) by covering the surface of the resistance adjustment layer 32.

The resistance adjustment layer 32 is formed by providing a resin composition around the peripheral face of the metal core 31 by extrusion molding, injection molding, or the like. The JIS D hardness of the resistance adjustment layer 32 is preferably at least 45 degrees in order to prevent the resistance adjustment layer 32 from deforming over time, which would change the gap between the photoconductor 1 and the charging roller 3*a*. There are no particular restrictions on the thermoplastic resin used for the resistance adjustment layer 32 so long as the JIS D hardness can be substantially maintained after molding. However, the use of polyethylene (PE), polypropylene (PP), polymethylmethacrylate (PMMA), polystyrene (PS), copolymers thereof (such as AS and ABS), and other such widely used resins is preferred because they can be easily molded.

The resistance adjustment layer 32 is preferably molded from a thermoplastic resin composition in which a macromolecular ion conductor has been dispersed. The volumetric resistivity of this resistance adjustment layer 32 is preferably between $10^6$ and $10^9$ Ω·cm. If the volumetric resistivity is over $10^9$ Ω·cm, the amount of charging may be inadequate and it may be impossible to obtain a charge potential sufficient to produce a uniform image on the photoconductor 1. If the volumetric resistivity is under $10^6$ Ω·cm, there will be leakage to the entire photoconductor 1.

The macromolecular ion conductor that is dispersed in this thermoplastic resin is preferably one whose resistance by itself is from $10^6$ and $10^9$ Ω·cm and readily lowers the resistance of the resin. Examples include compounds containing a polyether ester amide component. The added amount thereof is preferably from 30 to 70 weight parts per 100-weight parts substrate in order to adjust the resistance adjustment layer 32 to the desired value. A macromolecular compound containing quaternary ammonium salt group can also be used as the macromolecular ion conductor. An example is a polyolefin containing a quaternary ammonium salt group. The added amount thereof is preferably from 10 to 40 weight parts per 100-weight parts substrate in order to adjust the resistance of the resistance adjustment layer 32 to the desired value.

The dispersal of the macromolecular ion conductor in the thermoplastic resin can be accomplished by using a biaxial kneader, a regular kneader, or the like. Since an ion conductive material disperses uniformly at the molecular level in a matrix polymer, the resistance adjustment layer 32 is not subject to the variance in resistance value that accompanies poor dispersion of the conductive substance as seen in resistance adjustment layers in which a conductive pigment has been dispersed. Also, since the ion conductive material is a macromolecular compound, it is uniformly dispersed and fixed in the matrix polymer, making it less likely to bleed out.

The protective layer 33 is formed so as to have a higher resistance than the resistance adjustment layer 32, thereby avoiding leakage at defects onto the photoconductor 1. If the resistance of the protective layer 33 is too high, though, charging efficiency will decrease. Therefore, the difference between the resistance of the protective layer 33 and the resistance of resistance adjustment layer 32 is preferably no more than $10^3$ Ω·cm.

It is good for the material that forms the protective layer 33 to be a resin material because it will be easy to manufacture a film. This resin material is preferably a fluororesin, polyamide resin, polyester resin, or polyvinyl acetal resin because it will be non-adhesive property, and toner will not adhere thereto. Also, a resin material generally is electrically insulating, so if the protective layer 33 is formed from a resin material alone, it will not be able to serve as a charging roller. In view of this, the resistance of the protective layer 33 is adjusted by dispersing various kinds of conductor into the above-mentioned resin material. Further, an isocyanate or other such reaction curing agent may be dispersed in the resin material to enhance bonding between the protective layer 33 and the resistance adjustment layer 32.

The charging roller 3*a* is connected to a power supply, and a specific voltage is applied thereto. This voltage may be direct current (DC) voltage alone, but is preferably voltage consisting of alternating current (AC) voltage superimposed over DC voltage. Applying AC voltage allows the surface of the photoconductor 1 to be charged more uniformly. In this embodiment, AC voltage is superimposed over DC voltage.

Figure 4:
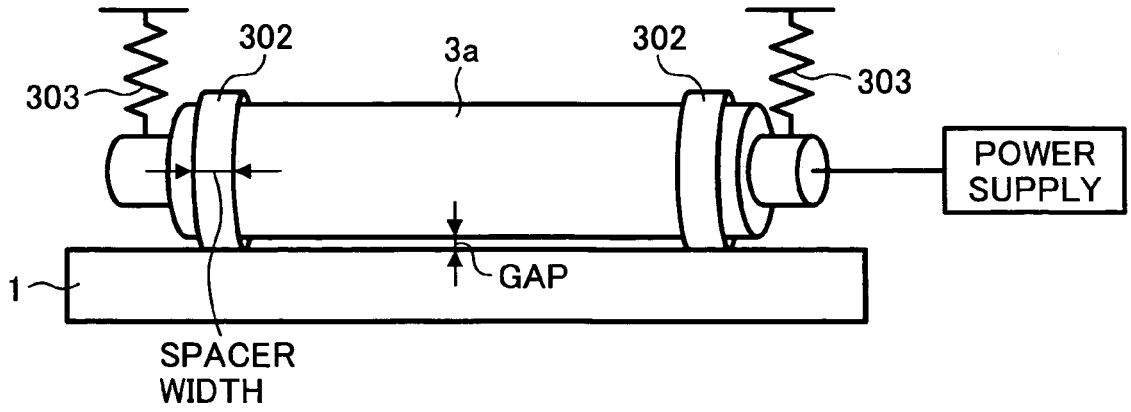
FIG. 4 is a diagram illustrating a method for maintaining a gap between the roller and an image support body according to an embodiment of the invention.

According to an embodiment of the present invention, the charging roller 3*a* is installed at a minute gap away from the photoconductor 1. This minute gap can be set, for example, by winding a spacer member having a specific thickness around the non-image formation regions at the ends of the charging roller 3*a*, and bringing the surface of the spacer members into contact with the surface of the photoconductor 1. As shown in FIG. 4, for example, the spacer member comprises films 302 wound around the ends of the charging roller 3*a*. These spacers 302 are in contact with the photosensitive surface of the photoconductor 1, and maintain a constant, minute gap in the image regions of the charging roller and the photoconductor. The applied bias comprises an AC-superimposed type of voltage being applied, and a discharge is produced at the minute gap between the charging roller and the photoconductor charges the photoconductor. Furthermore, pressing on the shaft with a spring 303 or the like increases the precision at which the minute gap is maintained.

It is preferable to make the gap between the photoconductor 1 and the charging roller 3*a* at 30±20 μm. If the charging roller 3*a* is touched with photoconductor 1, damage can be produced on the photoconductor 1, which induces outbreak of an abnormal picture.

Thus, precision of gap between the charging roller 3*a* and photoconductor 1 is important, and it is preferable to maintain precision of the gap over time. As discussed is the Background section, when a toner and a carrier get onto the spacers 302, the gap is fluctuated. And when the electric current between the charging roller 3*a* and the photoconductor 1 becomes lower than a necessary current, an abnormal picture occurs. In addition, when the gap exceeds an upper limit 50 μm, ozone and/or filming occurs. When the photoconductor 1 comes in contact with the charging roller 3*a*, damage is produced to the photo conductor 1, and finally the photoconductor layer is sharpened to allow a current leak.

Figure 5:
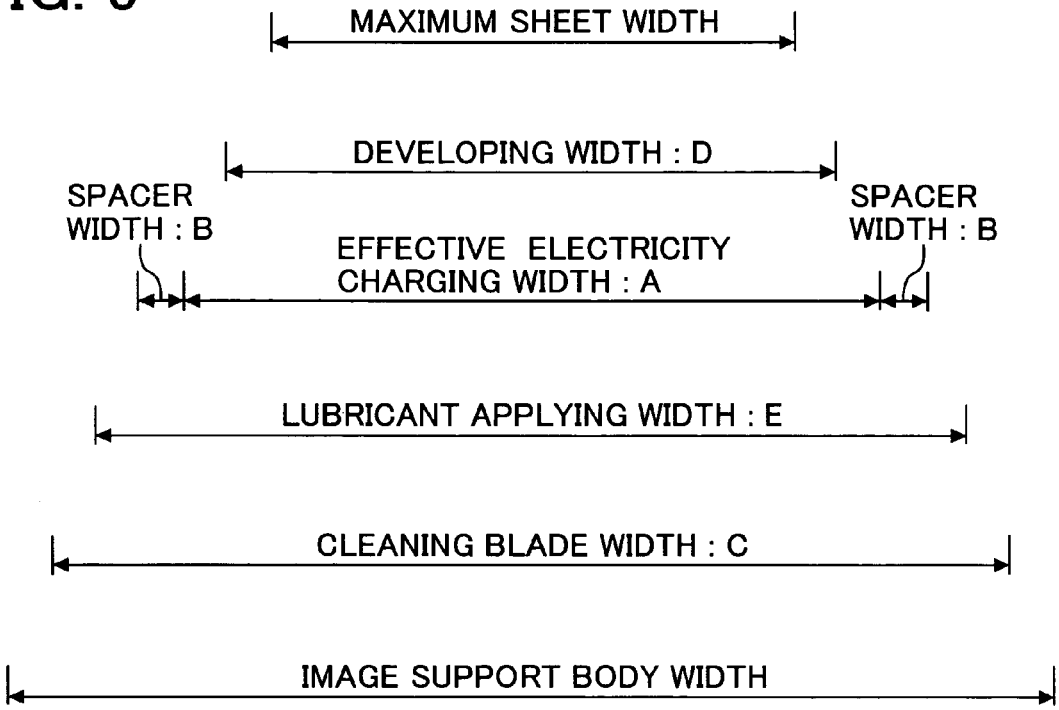
FIG. 5 is a diagram illustrating a relationship between a width of image-forming elements according to an embodiment of the invention.

The present inventors have discovered that regulating the width of elements of the image forming apparatus prevents (or reduces an amount of) a toner and a carrier from getting into the spacers, and removes a toner and a carrier that has bonded to the spacers. FIG. 5 is a schematic illustration that shows a relationship of widths of each image forming element of an image forming apparatus concerning the present invention. At first, C, which is a width of cleaning blade 7*a* contacting with the photoconductor 1, is made more than A+B, where B is a total width of all spacers 302 and A is an electricity charging effective width between the spacers 302. In the embodiment of FIG. 5, the spacers 302 are substantially the same width, but this is not required for the present invention. Further, any number of spacers may be used. Thus, "a total width of the spacer" as used herein defines a single width dimension where a single integral spacer is used, or defines the sum of a plurality of widths of a spacer having a plurality of discrete parts (such as the two spacer parts shown in FIG. 5). When C is equal to or greater than A+B, the cleaning blade 7*a* can remove a remaining toner and a carrier on the photoconductor surface, such that it becomes possible to prevent the toner and the carrier from getting into the spacers 302 of charge roller 3*a* and adhering to them.

Moreover, as the cleaning blade is wide enough to extend to or beyond the outside edges of the spacer films 302, any toner and/or developer that gets under (i.e., bonds to) the films 302 can be removed from the photoconductive drum 1. For example, where toner particles penetrate into the contact point between the spacer tape 302 and the photoconductor 1, such toner particles will at times remain on the photoconductive drum 1, and at other times remain on the tape when the tape 302 and drum 1 are rotated. By having the cleaning blade 7*a* equal to or wider than the outside edges of the tape 302, the blade 7*a* can remove any toner particle that remain on the photoconductive drum 1.

Next, in one embodiment, developing width D of developing device 5 that develops a latent image on the photoconductor 1 to make a visible image by developer, is less than the electricity charging effective width A. When D is less than A, it becomes possible to prevent the toner and the carrier from getting into the spacers of both ends of charging roller 3*a* and adhering to them. Next, in one embodiment, width A+B is less than or equal to a lubricant applying width E. Furthermore, lubricant applying width E is lower than or equal to cleaning width C that is cleaned by the cleaning blade on the photoconductor 1. When A+B is lower than or equal to E, and E is lower than or equal to C, a lubricant can be applied to a contact portion of photoconductor 1 that is equal to or wider than the cleaning blade. Then the lubricant is cleaned by cleaning blade 7*a*, and the bending of cleaning blade 7*a* is prevented to allow effective cleaning.

Next, A+B is less than or equal to width F that is cleaned by cleaning roller 3*b* of electricity charging device. When A+B is less than or equal to F, it becomes possible to remove any toner and the carrier that bonds to the spacers.

Figure 6:
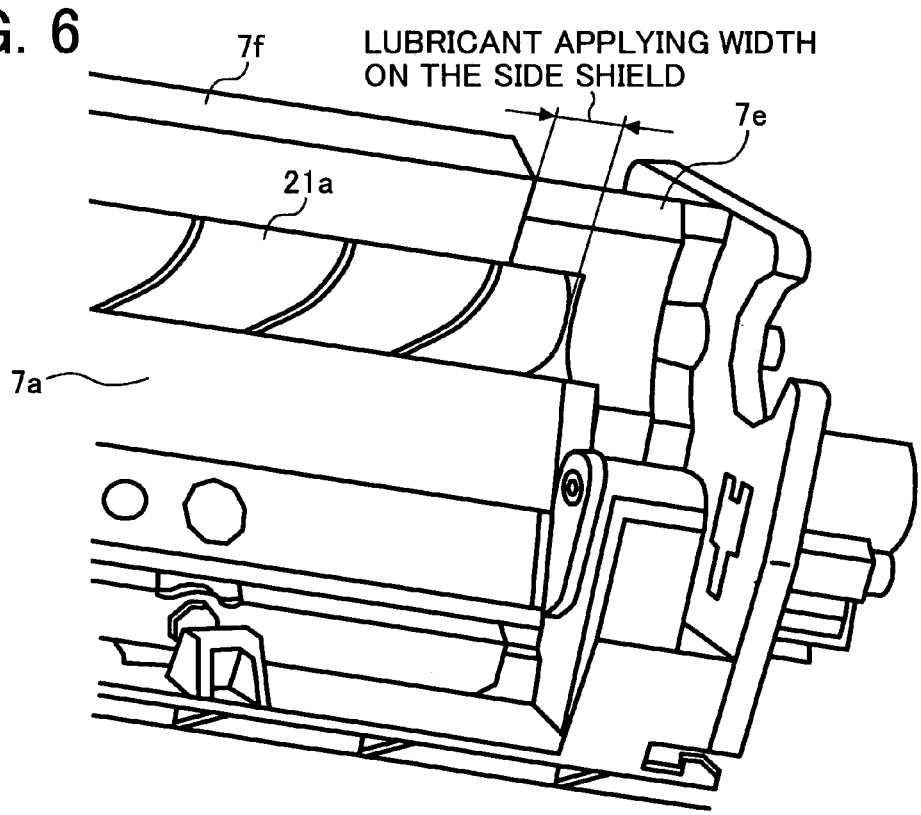
FIG. 6 is a diagram illustrating a lubricant applying width on a shield at an end of the image support body according to an embodiment of the invention.

FIG. 6 shows a perspective view of an end of the cleaning device as seen from the photoconductor 1 side. There is a prescribed gap (shown by arrows) between each end of cleaning case 7*f* of cleaning device 7 and a respective end of the photoconductor 1. The reason is that, when the cleaning case 7*f* come in contact with photoconductor 1, the rotation of photoconductor 1 is prevented, and photoconductor 1 is damaged. However, the gap causes toner that is removed by cleaning blade 7*a* to flow out from the gap and bond to recording media, which causes picture deterioration. Thus, according to an embodiment of the present invention, the clearance of both ends of cleaning case 7*f* is sealed by side shield 7*e* which can contact the photoconductor. Then, a lubricant is applied to side shield 7*e* to reduce the possibility of damage to the photoconductor 1 if the side shield 7*e* comes in contact with photoconductor 1, and to reduce the possibility of delay in its rotation.

As discussed in the Background section above, the use of small toner particles in conventional devices allowed the particles to easily bond to the tape spacers, thereby changing the gap and deteriorating image quality. However, as above mentioned, by preventing a toner or a carrier from getting into the spacers of a charge roller, and by removing the toner or the carrier from the spacers, the present invention can make it possible that the gap between the photoconductor 1 and the charging roller 3*a* can be maintained precisely even when small toner particles are used.

It may be more effective when a toner that has small diameter and spherical shape is used in this embodiment. It is preferred to use the toner having a volume average particle diameter (Dv) from 3 to 8 μm and a ratio (Dv/Dn) of the volume average particle diameter (Dv) to the number average particle diameter (Dn) from 1.00 to 1.40 in the developing device 5.

By using a toner having a small particle diameter, the toner can be adhered to the photoconductor with accuracy and improve resolution. However, when the volume average particle diameter of the toner is smaller than the range of above-mentioned embodiment, over time the toner in a double component developing device is melted and adhered to the surface of a magnetism carrier by agitating. This induces the deterioration of electricity charging ability of the magnetism carrier. Also, the toner in the single component developing device adheres to the developing roller as a film, and is melted and adhered to a blade such as a toner layer thinning blade. On the contrary, when the volume average particle diameter of the toner is larger than the range of above-mentioned embodiment, it becomes difficult to get high-resolution and high quality pictures, and fluctuation of particle size of the toner increases.

Also, by using a toner having a sharp particle diameter distribution, the toner charge distribution can be uniform, and it becomes possible to get high quality pictures that have less pollution of the picture surface, and high transferring rate. When the ratio (Dv/Dn) is larger than 1.40, the toner charge distribution is wide and quality images may be difficult to obtain.

The particle diameter of a toner can be measured using COULTER COUNTER TA-II type or MULTI-SIZER II (manufactured by Beckman Coulter, Inc.). In this embodiment, the distribution of toner number and distribution of toner volume is analyzed by COULTER COUNTER TA-II connecting to Interface (manufactured by Nikka-giken Corporation) and a personal computer (PC9801: manufactured by NEC Corporation).

The ratio of the wax, which is added inside or outside the toner to improve the toner release characteristics, and inorganic particles, which is added to improve the toner fluidity, to toner of above mentioned embodiment is higher than that of conventional toner because of the small diameter toner. And these additives become a factor in producing adhesive materials on the photoconductor 1. Thus, by being equipped with lubricant applying device 3 of the described embodiments, it is possible to make a uniform lubricant film over the surface of the photoconductor 1, and to reduce adhesive power of these adhesive materials to the surface of the photoconductor 1. In addition, it makes possible to reduce frictional force between the surface of the photo conductor 1 and cleaning blade 7*a* of cleaning device 7, and cleaning can be performed well.

Figure 7A:
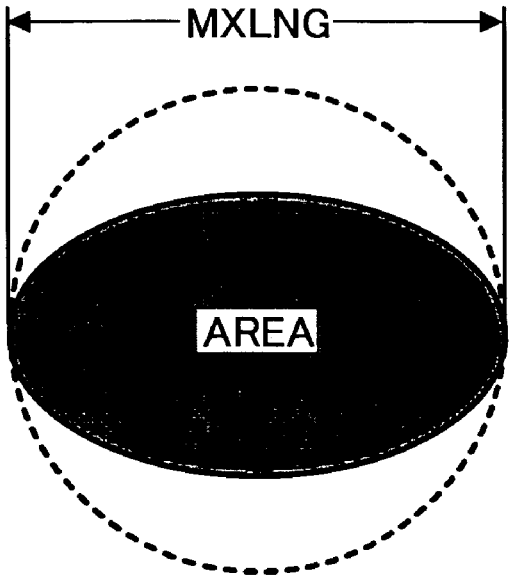
FIGS. 7A and 7B are schematic views showing exemplary toner shapes for the purpose of explaining shape coefficients SF-1 and SF-2 according to an embodiment of the invention.
Figure 7B:
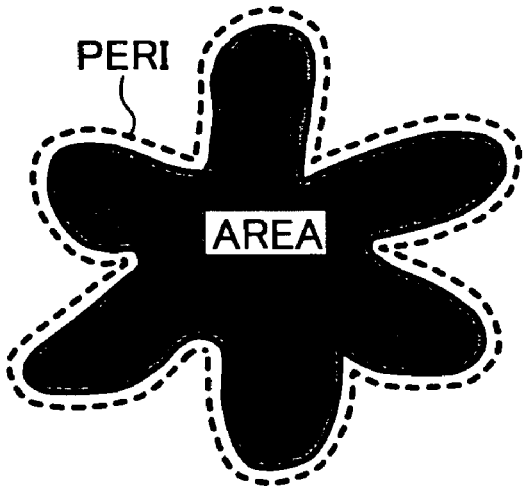

The toner for use in the developing device 5 preferably has a form factor SF-1 of from 100 to 180, and a form factor SF-2 of from 100 to 180 with regard to circularity. FIG. 7A and FIG. 7B show the form factor SF-1 and SF-2 of the toner particles. As shown in FIG. 7A, the form factor SF-1 is the degree of roundness of a toner particle and is defined by the following equation (1):

$$SF\text{-}1=((MXLNG)2/(AREA))\times(100\pi/4) \quad (1)$$

where MXLNG is a maximum diameter of the circle circumscribing the image of a toner particle obtained, for example, by observing the toner particle with a microscope, and AREA is the area of the image. When the SF-1 is 100, the toner particle is a true sphere. It can be said that as SF-1 increases, the toner form differs away from a true sphere form.

As illustrated in FIG. 7B, the form factor SF-2 is the degree of concavity and convexity of a toner particle and is defined by the following equation (2):

$$SF\text{-}2=((PERI)2/(AREA))\times(100\pi/4) \quad (2)$$

where PERI is the peripheral length, or perimeter, of the image of a toner particle observed, for example, by a microscope; and AREA is the area of the image. When the SF-2 is 100, the surface of the toner particle does not have any concavity or convexity. It can be said that as SF-2 increases, the toner surface becomes rough.

When the toner has a form close to a true sphere, the contact between toner particles becomes point to point contact. Thus, the adhesion force between toner particles weakens and therefore, the toner has a good fluidity. In addition, the adhesion force between the toner and the photoconductor 1 is also weak and the transfer rate of the toner is high. On the other hand, because the sphere toner is easy to enter the gap between the cleaning blade 7*a* and the photoconductor 1, it is preferred that the form factors SF-1 and SF-2 be moderately large.

However, when the form factors SF-1 and SF-2 are large, the toner is scattered on the image, resulting in deterioration of the quality of images. Therefore, it is preferred that SF-1 and SF-2 both be not greater than 180.

The form factors SF-1 and SF-2 are determined by the following method:

(1) a photograph of particles of a toner is taken using a scanning electron microscope (S-800, manufactured by Hitachi Ltd.); and (2) particle images of 100 toner particles are analyzed using an image analyzer (LUSEX 3 manufactured by Nireco Corp.).

A toner that can be used favorably in the image forming apparatus of this embodiment is one obtained by dissolving or dispersing at least a polyester prepolymer having a nitrogen atom-containing functional group, a polyester, a colorant, and a parting agent in an organic solvent, and subjecting the resulting toner material liquid to a crosslinking and/or extension reaction in an aqueous solvent. The materials constituting the toner, and the method for manufacturing the toner, will now be described.

[Modified Polyester]

Toner according to an embodiment of the present invention includes modified polyester (i) as a binder resin. As the modified polyester (i), the polyester resin may include a bond group other than an ester bond. Also, in the polyester resin, different resin constituents may be covalent and/or ion bonded to each other. Specifically, the modified polyester may result from modification of polyester residues by introducing a functional group such as an isocyanate group reacted with a hydroxyl group and a carboxylic acid group to polyester residues and further reacting the resulting compound with an active hydrogen including compound.

The modified polyester (i) may be urea-modified polyester generated by reaction of polyester prepolymer (A) having an isocyanate group and an amine class (B). The polyester prepolymer (A) having an isocyanate group may be generated by reacting polyester, which is a polycondensation compound of polyalcohol (PO) and polycarboxylic acid (PC) and includes polyester having an active hydrogen group, to a polyisocyanate (PIC) compound. Such an active hydrogen group of the polyester may be a hydroxyl group (alcoholic-hydroxyl group and phenolic-hydroxyl group), an amino group, a carboxyl group and a mercapto group.

Among these groups, the alcoholic-hydroxyl group is preferred.

The urea-modified polyester is generated as follows. A polyalcohol (PO) compound may be divalent alcohol (DIO) and tri- or more valent polyalcohol (TO). Only DIO or a mixture of DIO and a small amount of TO is preferred. The divalent alcohol (DIO) may be alkylene glycol (ethylene glycol, 1,3-propylene glycol, 1,4-butanediol, 1,6-hexanediol or the like), alkylene ether glycol (diethylene glycol, triethylene glycol, dipropyrene glycol, polyethylene glycol, polypropylene glycol, polytetramethylene ether glycol or the like), alicyclic diol (1,4-cyclohexane dimethanol, hydrogenated bisphenol A or the like), bisphenols (bisphenol A, bisphenol F, bisphenol S or the like), alkylene oxide adducts of above-mentioned alicyclic diols (ethylene oxide, propylene oxide, butylene oxide or the like), and alkylene oxide adducts of the above-mentioned bisphenols (ethylene oxide, propylene oxide, butylene oxide or the like).

Alkylene glycol having 2-12 carbon atoms and alkylene oxide adducts of bisphenols are preferred. In particular, the alkylene glycol having 2-12 carbon atoms and the alkylene oxide adducts of bisphenols are preferably used together. Tri- or more valent polyalcohol (TO) may be tri- to octa or more valent polyaliphatic alcohols (glycerin, trimethylolethane, trimethylol propane, pentaerythritol, sorbitol or the like), tri- or more valent phenols (trisphenol PA, phenol novolac, cresol novolac or the like), and alkylene oxide adducts of tri- or more valent polyphenols.

The polycarboxylic acid (PC) may be divalent carboxylic acid (DIC) and tri- or more valent polycarboxylic acid (TC). Only DIC or a mixture of DIC and a small amount of TC is preferred. The divalent carboxylic acid (DIC) may be alkylene dicarboxylic acid (succinic acid, adipic acid, sebacic acid or the like), alkenylene dicarboxylic acid (maleic acid, fumaric acid or the like), and aromatic dicarboxylic acid (phthalic acid, isophthalic acid, terephthalic acid, naphthalene dicarboxylic acid or the like). Alkenylene dicarboxylic acid having 4-20 carbon atoms and aromatic dicarboxylic acid having 8-20 carbon atoms are preferred. Tri- or more valent polycarboxylic acid may be aromatic polycarboxylic acid having 9-20 carbon atoms (trimellitic acid, pyromellitic acid or the like). Here, the polycarboxylic acid (PC) may be reacted to the polyalcohol (PO) by using acid anhydrides or lower alkyl ester (methylester, ethylester, isopropylester or the like) of the above-mentioned materials.

A ratio of the polyalcohol (PO) and the polycarboxylic acid (PC) is normally set between 2/1 and 1/1 as an equivalent ratio [OH]/[COOH] of a hydroxyl group [OH] and a carboxyl group [COOH]. The ratio preferably ranges from 1.5/1 through 1/1. In particular, the ratio is preferably between 1.3/1 and 1.02/1.

A polyisocyanate (PIC) compound may be aliphatic polyisocyanate (tetramethylene diisocyanate, hexamethylene diisocyanate, 2,6-diisocyanate methylcaproate or the like), alicyclic polyisocyanate (isophoron diisocyanate, cyclohexyl methane diisocyanate or the like), aromatic diisocyanate (trilene diisocyanate, diphenylmethane diisocyanate or the like), aromatic aliphatic diisocyanate (&agr;, &agr;, &agr;', &agr; '-tetramethyl xylylene diisocyanate), isocyanates, materials blocked against the polyisocyanate with phenol derivative, oxime, caprolactam or the like, and combinations of two or more of these materials.

The ratio of the polyisocyanate (PIC) compound is normally set between 5/1 and 1/1 as an equivalent ratio [NCO]/[OH] of the isocyanate group [NCO] and the hydroxyl group [OH] of polyester having a hydroxyl group. The ratio is preferably between 4/1 and 1.2/1. In particular, the ratio is preferably between 2.5/1 and 1.5/1. If the ratio [NCO]/[OH] is greater than or equal to 5.0, the ratio degrades low temperature fixability. If the mole ratio of [NCO] is less than or equal to 1.0, ester of urea-modified polyester includes a smaller amount of urea, thereby resulting in degraded hot offset proof.

Polyester prepolymer (A) having an isocyanate group normally includes 0.5 through 40 wt % (part by weight) of polyisocyanate (PIC) compound components. It is preferable that the contained amount be between 1 and 30 wt %. In particular, the amount is preferred between 2 and 20 wt %. If the contained amount is less than 0.5 wt %, the hot offset proof is degraded, and additionally heat-resistant storage capability and low temperature fixability become poor. On the other hand, if the contained amount is larger than or equal to 40 wt %, the low temperature fixability is degraded.

For each molecule of polyester prepolymer (A) having isocyanate groups, one or more isocyanate groups are normally contained.

Preferably, the average number of contained isocyanate groups is between 1.5 and 3.0. Further preferably, the average number is between 1.8 and 2.5. If each molecule of polyester prepolymer (A) contains less than one isocyanate group, the molecular weight of urea-modified polyester becomes lower and the hot offset proof is degraded.

Amines (B) which react with polyester prepolymer (A) may be a divalent amine compound (B1), a tri- or more valent polyamine compound (B2), amino alcohol (B3), amino mercaptane (B4), amino acid (B5), B1 to B5 compounds which amino groups are blocked (B6), or the like.

The divalent amine compound (B1) may be aromatic diamine (phenylene diamine, diethyltoluene diamine, 4,4'-diaminodiphenyl methane or the like), alicyclic diamine (4,4'-diamino-3,3'-dimethyldicyclohexylmethane, diamine cyclohexane, isophoron diamine or the like), and aliphatic diamine (ethylene diamine, tetramethylene diamine, hexamethylene diamine or the like). The tri- or more valent polyamine compound (B2) may be diethylene triamine, triethylene tetramine or the like. The amino alcohol (B3) may be ethanol amine, hydroxyethyl aniline or the like. The amino mercaptane (B4) may be aminoethyl mercaptan, aminopropyl mercaptan, or the like. The amino acid (B5) may be amino propionic acid, amino caproic acid or the like. The B1 to B5 compounds which amino groups are blocked (B6) may be ketimine compounds and oxazolidine compounds which can be obtained from the amines and ketones (acetone, methylethyl ketone, methylisobutyl ketone or the like) of B1 through B5. The amines (B) are preferably B1 and a mixture of B1 and a small amount of B2.

The ratio of amines (B) is normally set between 1/2 and 2/1 as an equivalent ratio [NCO]/[NHx] of isocyanate groups [NCO] in polyester prepolymer (A) having isocyanate groups to amino groups [NHx] in amines (B). Preferably, the ratio is between 1.5/1 and 1/1.5. Further preferably, the ratio is between 1.2/1 and 1/1.2. If the ratio is greater than 2 or less than 1/2, the molecular weight of urea-modified polyester is lowered and the hot offset proof is degraded.

Modified polyester (i) for an image forming apparatus according to an embodiment of the present invention can be manufactured in accordance with a one-shot method or prepolymer method. The weight-average molecular weight of the modified polyester (i) is normally greater than 10,000. Preferably, the weight-average molecular weight is between 20,000 and 10,000,000. Further preferably, the weight-average molecular weight is between 30,000 and 1,000,000. The peak molecular weight is preferably between 1,000 and 10,000. If the peak molecular weight is less than 1,000, an elongation reaction less likely occurs and the toner has smaller elasticity. As a result, the hot offset proof is degraded. On the other hand, if the peak molecular weight is greater than 10,000, the fixability is lowered, and it becomes more difficult to properly manufacture the toner in the matter of particle formation and pulverization. The number-average molecular weight of the modified polyester (i), if unmodified polyester (ii) is used, is not limited. The modified polyester (i) may have any number-average molecular weight such that the weight-average molecular weight can be within the above-mentioned range. If only the modified polyester (i) is used, the number-average molecular weight is normally set as less than 20,000. Preferably, the number-average molecular weight is set between 1,000 and 10,000. Further preferably, the number-average molecular weight is between 2,000 and 8,000. If the number-average molecular weight is larger than 20,000, the low temperature fixability and the brightness for a full-color device are degraded.

In a bridge reaction and/or elongation reaction of polyester prepolymer (A) and amines (B), which is for generating modified polyester (i), a reaction terminating agent may be used as needed to adjust the molecular weight of obtained urea-modified polyester. Such a reaction terminating agent may be monoamine (diethylamine, dibutylamine, butylamine, lauryl amine or the like), and compounds thereof which amines are blocked compounds (ketimine compounds).

[Unmodified Polyester]

Although only the modified polyester (i) can be used as described above, in one embodiment of the present invention unmodified polyester (ii) together with the modified polyester (i) can be contained as a binder resin constituent. When the unmodified polyester (ii) is used together, it is possible to achieve better low temperature fixability and brightness for a full-color device than those obtained for use of only the modified polyester. The unmodified polyester (ii) may be polycondensation compounds of polyalcohol (PO) and polycarboxylic acid (PC) as in the above-mentioned polyester components of the modified polyester (i). The same materials as those of the modified polyester (i) are preferred. Also, the unmodified polyester (ii) may be compounds modified in chemical bonding other than urea bonding as well as unmodified polyester. For example, the polyester is modified in urethane bonding. It is preferable that at least a portion of both the modified and unmodified polyester (i) and (ii) is dissolved in terms of low temperature fixability and hot offset proof. Accordingly, the modified and unmodified polyester (i) and (ii) preferably have similar polyester compositions. If the unmodified polyester (ii) is included, the weight ratio of the modified polyester (i) to the unmodified polyester (ii) is normally set between 5/95 through 80/20. Preferably, the weight ratio is between 5/95 and 30/70. Moreover preferably, the weight ratio is between 5/95 and 25/75. In particular, the weight ratio is preferably between 7/93 and 20/80. If the weight ratio is less than 5%, the hot offset proof is degraded, and additionally the heat-resistant storage capability and the low temperature fixability become poor.

The peak molecular weight of the unmodified polyester (ii) is normally set between 1,000 and 10,000. Preferably, the peak molecular weight is between 2,000 and 8,000. Moreover preferably, the peak molecular weight is between 2,000 and 5,000. If the peak molecular weight is less than 1,000, the heat-resistant storage capability is degraded. On the other hand, if the peak molecular weight is greater than 10,000, the low temperature fixability is degraded. Also, the unmodified polyester (ii) has penta- or more valent hydroxyl groups. Moreover preferably, 10 through 120 valent hydroxyl groups are preferred. In particular, 20 through 80 valent hydroxyl groups are preferred. If the unmodified polyester (ii) has tetra- or less valent hydroxyl groups, the unmodified polyester (ii) is not preferred in terms of both the heat-resistant storage capability and the low temperature fixability. It is preferable that the acid value of the unmodified polyester be between one and five. Moreover preferably, the acid number is within two through four. Since high acid value wax is used, and low acid value binder is linked to electrification and high volume resistance, such unmodified polyester (ii) is suitable for toner used as a binary developer.

A glass transition point (Tg) of binder resin is normally set to be within 35 through 70° C. Preferably, Tg is within 55 through 65° C. If Tg is less than 35° C., the heat-resistant storage capability is degraded. On the other hand, if Tg is greater than 70° C., the low temperature fixability becomes insufficient. Urea-modified polyester is likely to be on the surfaces of obtained toner parent body particles. Accordingly, toner according to an embodiment of the present invention, even if the glass transition point is low, tends to show better heat-resistant storage capability than known polyester toner does.

[Colorant]

All known dyes and pigments are available as a colorant of toner according to an embodiment of the present invention. For example, such a colorant mat be carbon black, nigrosine dye, iron black, naphtol yellow-S, Hansa yellow (10G, 5G, G), cadmium yellow, yellow oxide, ocher, chrome yellow, titanium yellow, polyazo yellow, oil yellow, Hansa yellow (GR, A, RN, R), pigment yellow L, benzidine yellow (G, GR), permanent yellow (NCG), vulcan fast yellow (5G, R), tartrazine lake, quinoline yellow lake, anthrazane yellow BGL, isoindolinone yellow, colcothar, minium, lead vermilion, cadmium red, cadmium mercury red, antimony vermilion, permanent red 4R, para red, para-chloro-ortho-nitroaniline red, lithol fast scarlet G, brilliant fast scarlet, brilliant carmine BS, permanent red (F2R, F4R, FRL, FRLL, F4RH), fast scarlet VD, brilliant scarlet G, lithol rubin GX, permanent red F5R, brilliant carmine 6B, pigment scarlet 3B, bordeaux 5B, toluidine maroon, permanent bordeaux F2K, helio bordeaux BL, bordeaux 10B, BON marron light, BON marron medium, eosine lake, rhodamine lake B, rhodamine lake Y, alizarine lake, thioindigo red B, thioindigo maroon, oil red, quinacridone red, pyrazolone red, polyazo red, chrome vermilion, benzidine orange, perynone orange, oil orange, cobalt blue, cerulean blue, alkali blue lake, peacock blue lake, Victoria blue lake, no metal-containing phthalocyanine blue, phthalocyanine blue, fast sky blue, indanthrene blue (RS, BC), indigo, ultramarine blue, Prussian blue, anthraquinone blue, fast violet B, methyl violet lake, cobalt violet, manganese violet, dioxane violet, anthraquinone violet, chrome green, zinc green, chromium oxide, viridian, emerald green, pigment green B. naphthol green B, green gold, acid green lake, malachite green lake, phthalocyanine green, anthraquinone green, titanium oxide, zinc white, Litobon and mixtures thereof. The containing amount of a colorant in toner is normally set between 1 and 15 weight percent. Preferably, the containing amount is between 3 and 10 weight percent.

A colorant may be used as masterbatch combined with resin. Such masterbatch may be manufactured from or mixed as binder resin together with: polystyrene, poly-p-chlorostyrene, styrenes such as polyvinyltoluene and substituted polymer thereof, copolymer of the above-mentioned compounds and vinyl compounds, polymethyl methacrylate, polybutyl methacrylate, polyvinyl chloride, polyvinyl acetate, polyethylene, polypropylene, polyester, epoxy resin, epoxy polyol resin, polyurethane, polyamide, polyvinyl butylal, polyacrylate resin, rosin, modified rosin, terpene resin, aliphatic or alicyclic hydrocarbon resin, aromatic petroleum resin, chlorinated paraffin, paraffin wax or the like. These materials can be used as a single material or a compound thereof.

[Charge Control Agent]

In embodiments of present invention, existing charge control agents are available. For example, the charge control agent may be nigrosin dye, triphenylmethane dye, chrome-containing metal complex dye, moribdate-chelated pigment, rhodamine dye, alkoxy amine, quaternary ammonium salt (including fluoride-modified quaternary ammonium salt), alkylamide, phosphorous or phosphorous-containing compounds, tungsten or tungsten-containing compounds, fluorinated active agent, metal salicylate, salicylate derivative metal salts or the like. Specifically, the charge control agent may be nigrosin dye BONTRON 03, quaternary ammonium salt BONTRON-P-51, metal-containing azo dye BONTRON S-34, oxynaphthate metal complex E-82, salicylate metal complex E-84, phenolic condensate E-89 (which are produced by Orient Chemical Industries Ltd.), molybdenum complex with quaternary ammonium salt TP-302 and TP-415 (which are produced by Hodogaya Chemical Co., Ltd.), quaternary ammonium salt copy charge PSY VP2038, triphenylmethane derivatives copy blue PR, quaternary ammonium salt copy charge NEG VP2036, copy charge NX VP434 (which are produced by Hoechst), LRA-901, boron complex LR-147 (which are produced by Japan Carlit Co., Ltd.), copper phthalocyanine, perylene, quinacridone, azo pigment, and high-molecular-weight-compounds having sulfonyl, carboxyl, or quaternary ammonium salt group. In particular, materials that can control toner to have negative polarity are preferably used.

The use amount of the charge control agent is determined depending on types of binder resin, presence of additives used as needed, and toner manufacturing methods including a dispersion method, and therefore cannot be not uniquely determined. However, the charge control agent is normally used within a weight part of 0.1 through 10 for the weight part 100 of binder resin. Preferably, the charge control agent is within a weight part of 0.2 through 5. If the weight is above 10, toner particles are electrified too much. As a result, the charge control agent becomes less effective, resulting in increasing electrostatic suction power with a developing roller, decreasing fixability of developer, and lowered image density.

[Release Agent]

Low melting point waxes, for example which have a melting point of 50 through 120° C., are available as a release agent. Such low melting point waxes effectively work as a release agent between a fixing roller and a toner boundary in dispersion with binder resin. Thereby, it is possible to realize effective high temperature offset without applying a release agent, such as oil, on the fixing roller. Such waxes may have the following constituents. Brazing filler metal and waxes may include waxes derived from plants, such as carnauba, cotton brazing filter metal, wood brazing filter metal, rice brazing filter metal, waxes derived from animals, such as yellow beeswax and lanolin, waxes derived from mineral substances, such as ozokerite and cercine, and petroleum waxes, such as paraffin wax, microcrystalline, and petrolatum. Apart from these natural waxes, synthesized hydrocarbon waxes, such as Fischer-Tropsch wax and polyethylene wax, and synthesized wax, such as ester, ketone and ether, may be used. In addition, aliphatic amide such as 12-hydroxystearate amide, amide stearate, imide phthalate anhydride and chlorinated hydrocarbon, crystalline polymer resin having low molecular weight homopolymer or copolymer such as poly-n-laurylmethacrylate and poly-n-stearylmethacrylate (for example, n-stearylacrylate-ethylmethacrylate copolymer), and crystalline polymer which side chain has long alkyl group may be used.

A charge control agent and a release agent together with masterbatch and binder resin may be fused and mixed, and may be dissolved and dispersed in organic solvent.

[External Additives]

Inorganic fine particles are preferably used as an external additive to facilitate flowability, developability and electrifiability of toner particles. Such an inorganic fine particle preferably has a primary particle diameter of $5\times10^{-3}$ through 2 μm. In particular, it is preferable that the primary particle diameter be between $5\times10^{-3}$ and 0.5 μm. BET specific surface area is preferably between 20 and 500 $m^2/g$. The use ratio of the inorganic fine particles is preferably between 0.01 and 5 wt % to toner particles. In particular, the use ratio is preferably between 0.01 and 2.0 wt %.

Specifically, such inorganic particles may be formed of silica, alumina, titanium oxide, barium titanate, magnesium titanate, calcium titanate, strontium titanate, zinc oxide, tin oxide, silica sand, clay, mica, wollatonite, diatomite, chromium oxide, cerium oxide, colcothar, antimony trioxide, magnesium oxide, zirconium oxide, barium sulfate, barium carbonate, calcium carbonate, silicon carbide, silicon nitride or the like. Among these materials, hydrophobic silica particles and hydrophobic titanium oxide particles are used together as an agent to provide flowability. In particular, when these particles having an average diameter of less than $5\times10^{-2}$ μm are mixed, an electrostatic force and Van der Waals force with toner particles are considerably improved. As a result, even if such external additives are mixed with toner particles in a developing device to achieve a desired electrification level, it is possible to obtain a firefly-free good image without desorption of a flowability accelerator agent from toner particles, and further reduce an amount of remaining toner after transferring.

While titanium oxide fine particles have high environmental stability and image density stability, the titanium oxide fine particles have an insufficient electrification start feature. As a result, if more titanium oxide fine particles are contained than silica fine particles, this adverse effect becomes more influential. However, if hydrophobic silica particles and hydrophobic titanium oxide particles are contained within 0.3 through 1.5 wt %, a desired electrification start feature is obtained without significant damage. In other words, even if an image is repeatedly copied, it is possible to achieve stable image quality for each copy.

Preferred embodiments of a toner manufacturing method according to the present invention are described below. However, the present invention is not limited to these embodiments.

[Toner Manufacturing Method]

1) To produce toner material liquid, colorant, unmodified polyester, polyester prepolymer having isocyanate group, and a release agent are dispersed in organic solvent.

From the viewpoint of removal after formation of toner source particles, it is preferable that the organic solvent be volatile and have a boiling point of less than 100° C. Specifically, toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methylethylketone, methylisobutylketone, and compounds thereof are available. In particular, aromatic solvent such as toluene and xylene, and chlorinated hydrocarbon such as methylene chloride, 1,2-dichloroethane, chloroform and carbon tetrachloride, are preferred. For 100 w/t parts of polyester prepolymer, 0 through 300 w/t parts of organic solvent are normally used. Preferably, 0 through 100 w/t parts are used. Further preferably, 25 through 70 w/t parts are used.

2) The toner material liquid together with a surface-active agent and resin fine particles is emulsified in aqueous solvent.

Such aqueous solvent may be water or organic solvent such as alcohol (methanol, isopropyl alcohol, ethylene glycol or the like), dimethyl formamide, tetrahydrofuran, cellosolves (methylcellosolve), lower ketones (acetone, methylethylketone or the like).

For 100 w/t parts of the toner material liquid, 50 through 2,000 w/t parts of aqueous solvent is normally used. The 100 through 1,000 w/t parts are preferred. If the part by weight of the aqueous solvent is less than 50, the toner material liquid is poorly dispersed, and thereby it is difficult to obtain toner particles having a predefined diameter. On the other hand, if the part by weight of the aqueous solvent is larger than 20,000, that is economically inefficient.

Also, for the purpose of good dispersion in aqueous solvent, a dispersion agent such as a surface-active agent and resin fine particles can be added as needed.

Such a surface-active agent may be alkylbenzene sulfonate salt, &agr;-olefin sulfonate salt, anionic surfactant such as phosphate ester, alkyl amine salt, aminoalcohol fatty acid derivatives, polyamine fatty acid derivatives, amine salt such as imidazoline, alkyltrimethyl ammonium salt, dialkyldimethyl ammonium salt, alkyldimethylbenzyl ammonium salt, pyridinium salt, alkylisoquinolinium salt, cationic surfactant quaternary ammonium salt such as benzethonium chloride, fatty amide derivatives, non-ionic surfactant such as multivalent alcohol derivatives, and amphoteric surfactant such as alanine, dodecyl (aminoethyl) glycine, di(octylaminoethyl) glycine, N-alkyl-N,N-dimethylammonium betaine.

Also, even if a small amount of a surface-active agent having a fluoroalkyl group is used, the surface-active agent works well. Preferred anionic surfactant having fluoroalkyl group may be fluoroalkylcarboxylic acid having 2-10 carbon atoms and metal salt thereof, disodium perfluorooctanesulfonyl glutamate, sodium 3-[&ohgr;-fluoroalkyl(C6-C11)oxy]-1-alkyl (C3-C4) sulfonate, sodium 3-[&ohgr;-fluoroalkanoyl (C6-C8)oxy]-N-ethylamino]-1-propane sulfonate, fluoroalkyl (C11-C20) carboxylic acid and metal salts thereof, perfluoroalkylcarboxilic acid (C7-C13) and metal salts thereof, perfluoroalkyl (C4-C12) sulfonic acid and metal salt thereof, perfluorooctanesulfonic acid diethanolamide, N-propyl-N-(2-hydroxyethyl)-perfluorooctanesulfonamide, propyltrimethylammonium salt of a perfluoroalkyl (C6-C10) sulfonamide, salt of perfluoroalkyl (C6-C10)-N-ethylsulfonylglycine, monoperfluoroalkyl (C6-C16) ethyl phosphate ester or the like.

Commercially, Surflon S-111, S-112 and S113 (which are produced by Asahi Glass Co., Ltd.), Florad FC-93, FC-95, FC-98 and FC-129 (which are produced by Sumitomo 3M Ltd.), Unidyne DS-101 and DS-102 (which are produced by Daikin Industry Ltd.), Megaface F-110, F-120, F-113, F-191, F-812 and F-833 (which are produced by Dainippon Ink and Chemicals, Inc.), Ektop EF-102, EF-103, EF-104, EF-105, EF-112, EF-123A, EF-123B, EF-306A, EF-501, EF-201 and EF-204 (which are produced by Tohkem products), and Ftergent F-100 and F-150 (which are produced by Neos) are available.

Also, a cationic surfactant may be aliphatic primary or secondary amino acid having fluoroalkyl group, aliphatic quaternary ammonium salt such as ammonium salt of perfluoroalkyl (C6-C10) sulfonamide propyltrimethyl, benzalkonium salt, benzethonium chloride, pyridinium salt, imidazolinium salt, commercially, Surflon S-121, Florad FC-135, Unidyne DS-202, Megaface F-150 and F-824, Ektop EF-132, Ftergent F-300 or the like.

Resin fine particles are added to stabilize toner source particles formed in aqueous solvent. The resin fine particles are preferably added such that the coverage ratio thereof on the surface of a toner source particle can be within 10 through 90%. For example, such resin fine particles may be methyl polymethacrylate particles of 1 μm and 3 μm, polystyrene particles of 0.5 μm and 2 μm, poly(styrene-acrylonitrile)particles of 1 μm, commercially, PB-200 (which is produced by Kao Co.), SGP, SGP-3G (Soken), technopolymer SB (Sekisui Plastics Co., Ltd.), micropearl (Sekisui Chemical Co., Ltd.) or the like.

Also, inorganic dispersant such as calcium triphosphate, calcium carbonate, titanium oxide, colloidal silica and hydroxyapatite may be used.

To make dispersed drops stable, polymer protective colloid may be used together with the above-mentioned resin fine particles and inorganic dispersant. For example, acid compounds such as acrylic acid, methacrylic acid, α-cyanoacrylic acid, α-cyanomethacrylic acid, itaconic acid, crotonic acid, fumaric acid, maleic acid and maleic anhydride, or (meth) acrylic monomer with a hydroxyl group such as β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, ester from diethylene glycol and monoacrylic acid, ester from diethylene glycol and monomethacrylic acid, ester from glycerin and monoarylic acid, ester from glycerin and monometharylic acid, N-methylolacrylamide and N-methylolmethacrylamide, vinyl alcohol or ethers from vinyl alcohol such as vinylmethyether, vinylethylether and vinylpropylether, esters from vinylalcohol and compound having carboxylic group such as vinyl acetate, vinyl propionate and vinyl lactate, acrylamide, methacrylamide, diacetoneacrylamide or methylol compounds thereof, acid chlorides such as acryloyl chloride and methacrylate chloride, nitrogen-containing compounds such as vinylpyridine, vinylpyrrolidone, vinylimidazol and ethyleneimine, homopolymer or co-polymer having heterocycles thereof, polyoxyethylene-based ones such as polyoxyethylene, polyoxypropylene, polyoxyethylene alkylamine, polyoxypropylene alkylamine, polyoxyethylene alkylaamide, polyoxypropylene alkylamide, polyoxyethylene nonylphenyl ether, polyoxyethylene laurylphenyl ether, polyoxyethylene stearyl phenyl ester and polyoxyethylene nonyl phenyl ester, and celluloses such as methyl cellulose, hydroxyethyl cellulose and hydroxypropyl cellulose, are available.

The present invention is not limited to any certain dispersion method. Well-known techniques, such as low-speed shred type, high-speed shred type, friction type, high-pressure jet type and ultrasonic type, are available. In particular, the high-speed shred type dispersion apparatus is preferred to obtain dispersed particles having a diameter of 2 through 20 μm. If such a high-speed shred type dispersion apparatus is used, the rotation speed is not limited. However, the rotation speed is normally set within 1,000 through 30,000 rpm. Preferably, the rotation speed is within 5,000 through 20,000 rpm. Also, although the dispersion time is not limited to a certain time period, the dispersion time is normally set within 0.1 through 5 minutes for a batch method. The temperature during dispersion is normally kept between 0 and 150° C. (under pressure). Preferably, the temperature is kept between 40 and 98° C.

3) During production of emulsion liquid, amines (B) are added to react with polyester prepolymer (A) having isocyanate group.

This reaction involves bridge and/or elongation of molecule chain. The reaction time is determined depending on reactivity of the structure of the isocyanate group of the polyester prepolymer (A) and the amines (B). The reaction time is normally set between 10 minutes and 40 hours. Preferably, the reaction time is set between 2 and 24 hours. In addition, existing catalysts may be used as needed. Specifically, dibutyl tin laurate, dioctyl tin laurate or the like are available.

4) After completion of the reaction, organic solvent is removed from the emulsified dispersed reactant, and subsequently the resulting material is cleaned and dried to obtain toner source particles.

To remove the organic solvent, for example, the emulsified dispersed reactant is gradually heated while laminar flow is stirred. After brisk stirring in a certain temperature range, it is possible to produce spindle-shaped toner source particles by removing the organic solvent. Also, if acids such as calcium phosphates or alkali soluble materials are used as a dispersion stabilizing agent, such calcium phosphates are dissolved by using acids such as hydrochloric acid, and then the resulting material is cleaned by using water so as to remove the calcium phosphates from the toner source particles. The removal may be conducted through enzyme decomposition.

5) A charge control agent is provided to the obtained toner source particles. Then, inorganic particles such as silica particles and titanium oxide particles are added to obtain toner.

In accordance with a well-known method, for example, a method using a mixer, the charge control agent is provided, and the inorganic particles are added.

According to the above-mentioned toner manufacturing method, it is possible to easily obtain toner particles having a small diameter and a sharp diameter distribution. Furthermore, if emulsified dispersed reactant is intensively stirred during a removal process of organic solvent, it is possible to control the shape of toner source particles between true spherical shape and spindle shape. Moreover, it is possible to control surface morphology between smooth surface and rough surface.

Toner according to an embodiment of the present invention has an almost spherical shape as in the following shape definition.

Figure 8A:
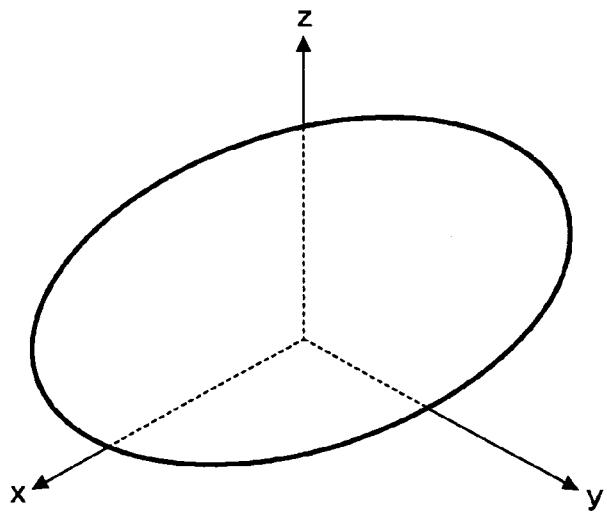
FIGS. 8A through 8C show exemplary shapes of a toner particle according to an embodiment of the present invention.
Figure 8B:
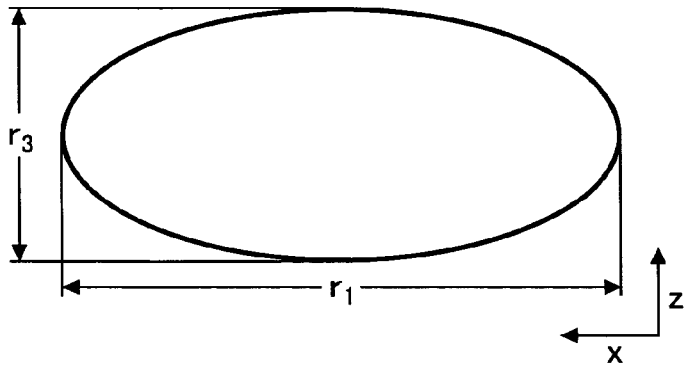
Figure 8C:
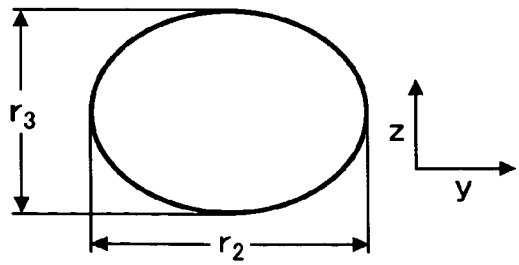

FIGS. 8A through 8C are schematic views showing an exemplary shape of a toner particle according to an embodiment of the present invention.

Referring to FIGS. 8A through 8C, such an almost spherical toner particle is defined by the major axial length r1, the minor axial length r2 and the thickness r3 (r1≧r2≧r3). A toner particle according to an embodiment of the present invention preferably has a shape such that the ratio of the minor axial length r2 to the major axial length r1 (r2/r1) is between 0.5 and 1.0, and the ratio of the thickness r3 to the minor axial length r2 (r3/r2) is between 0.7 and 1.0. If the ratio (r2/r1) is less than 0.5, the toner particle is substantially different from true spherical shape. As a result, it is difficult to obtain high-quality images because of insufficient dot reproducibility and transfer efficiency. Also, if the ratio (r2/r1) is less than 0.7, the toner particle has a nearly flat shape. As a result, it is difficult to achieve a high transfer rate unlike a spherical toner particle. In particular, if the ratio (r3/r2) is equal to 1.0, the toner particle has a body of rotation. As a result, it is possible to improve toner flowability.

It is noted that the lengths r1, r2 and r3 are measured by taking pictures of the toner particle from different viewing angles by using a scanning electron microscope (SEM).

Toner manufactured in this manner can be used as single-component magnetic toner without magnetic carrier or non-magnetic toner.

Also, if the manufactured toner is used in two-component developer, the toner may be mixed with magnetic carrier. Such magnetic carrier may be a ferrite containing divalent metal such as iron, magnetite, manganese, zinc and copper, and preferably has a volume average particle diameter of 20 through 100 μm. If the average particle diameter is less than 20 μm, it is likely that carrier may be attached on the photoconductor 1 during development. On the other hand, if the average diameter is larger than 100 μm, toner particles are insufficiently electrified because of an unsatisfactory mixture. In this case, when the developing device is continuously operated, there is a risk that electrification may malfunction. Also, zinc containing Cu ferrite is preferred because of high saturation magnetization. However, ferrite may be selected depending on a process of the image forming apparatus 100. Magnetic carrier covering resin is not limited to a certain resin. For example, the magnetic carrier covering resin may be silicone resin, styrene-acryl resin, fluorine-contained resin, olefin resin or the like. The magnetic carrier covering resin may be manufactured by dissolving coating resin in solvent and spaying the resulting solution in a fluidized bed to coat the resin on a core. Alternatively, after resin particles are electrostatically attached to core particles, the resulting particles may be melt for the coverage. The thickness of the covered resin is normally between 0.05 and 10 μm, and preferably between 0.3 and 4 μm.

What is claimed as new and desired to be secured by Letters Patent of the United States is:

1. An image forming apparatus comprising:

an image support body configured to support a latent image;

a charging member configured to provide a substantially uniform charge to a surface of the image support body;

a spacer coupled to said charging member and configured to contact said image support body to maintain a gap between the image support body and the charging member;

an exposing part configured to expose the charged surface of the image support body to write the latent image based on image data;

a developing part configured to develop the latent image by supplying toner particles to the latent image formed on the surface of the image support body to make the latent image a visible image;

a transferring part configured to transfer the visible image on the surface of the image support body onto a transferring medium;

a cleaning part configured to clean the surface of the image support body after the transferring, said cleaning part being configured to satisfy the relationship $A+B \leqq C$, where A is a width of the effective charging area of the charging member that charges a surface of the image support body, B is a total width of the spacer that contacts the image support body, and C is a width of cleaning part that contacts the image support body; and a lubricant applying part configured to apply a lubricant to the surface of the image support body, wherein the relationship $A+B \leqq E \leqq C$ is satisfied, where E is a width of lubricant applying part that applies a lubricant to the surface of the image support body.

2. An image forming apparatus as claimed in claim 1, wherein the charging member is further configured to use DC and AC bias voltages to provide the substantially uniform charge on a surface of the image support body.

3. An image forming apparatus as claimed in claim 1, further comprising a developing part that develops a latent image formed on the surface of the image support body, said developing part configured to satisfy the relationship $D<A$, where D is a width of the developing part.

4. An image forming apparatus as claimed in claim 1, further comprising a shield part configured to contact a contact surface of the image support body at an end of the image support body, wherein the lubricant applying part is configured to apply the lubricant to the contact surface of the image support body and the shield part.

5. An image forming apparatus comprising:

an image support body configured to support a latent image;

a charging member configured to provide a substantially uniform charge to a surface of the image support body;

a spacer coupled to said charging member and configured to contact said image support body to maintain a gap between the image support body and the charging member;

an exposing part configured to expose the charged surface of the image support body to write the latent image based on image data;

a developing part configured to develop the latent image by supplying toner particles to the latent image formed on the surface of the image support body to make the latent image a visible image;

a transferring part configured to transfer the visible image on the surface of the image support body onto a transferring medium;

a cleaning part configured to clean the surface of the image support body after the transferring, said cleaning part being configured to satisfy the relationship $A+B \leqq C$, where A is a width of the effective charging area of the charging member that charges a surface of the image support body, B is a total width of the spacer that contacts the image support body, and C is a width of cleaning part that contacts the image support body; and a charging member cleaning part configured to clean the surface of the charging member, wherein the relationship $A+B \leqq F$ is satisfied, where F is a width of the charging member cleaning part that cleans the surface of the charging member.

6. The image forming apparatus as claimed in claim 1, wherein an average roundness of each of the toner particles is greater than or equal to 0.93 and smaller than or equal to 1.00.

7. The image forming apparatus as claimed in claim 1, wherein each of the toner particles has a ratio (Dv/Dn) of the volume average particle diameter (Dv) to a number average particle diameter (Dn), that is between 1.00 through 1.40.

8. The image forming apparatus as claimed in claim 1 wherein each of the toner particles has shape defined by a major axial length r1, a minor axial length r2 and a thickness r3, where $r1 \geqq r2 \geqq r3$, and ratios r2/r1 and r3/r2 are between 0.5 and 1.0 and between 0.7 and 1.0, respectively.

9. A method for producing improved images in an image forming apparatus, comprising:

positioning a charging member adjacent to an image support body, the charging member being configured to charge a surface of the image support body;

providing a spacer in contact with said charging member and image support body such that an area of the charging member is maintained at a gap distance from an area of the image support body;

providing a cleaning member in contact with said image support body, the cleaning member having a predetermined width that reduces an amount of toner particles that can bond to the spacer during image formation such that said gap distance is maintained substantially constant over time; and providing a shield part configured to contact an end portion at the end of the image support body in order to shield toner removed by the cleaning member from flowing out from the end of the image support body and bonding to an image transfer medium, wherein said predetermined width satisfies that relationship $A+B \leqq C$, where A is a width of the area of the charging member that is maintained at a gap distance from an area of the image support body, B is a total width of said spacer and C is said predetermined width of the cleaning member; and providing a lubricant applying part adjacent to the image support body and configured to apply lubricant to a surface of the image support body, wherein the lubricant applying part has a width E that satisfies the relationship $A+B \leqq E \leqq C$.

10. A method for producing improved images in an image forming apparatus, comprising:

positioning a charging member adjacent to an image support body, the charging member being configured to charge a surface of the image support body;

providing a spacer in contact with said charging member and image support body such that an area of the charging member is maintained at a gap distance from an area of the image support body;

providing a cleaning member in contact with said image support body, the cleaning member having a predetermined width that reduces an amount of toner particles that can bond to the spacer during image formation such that said gap distance is maintained substantially constant over time; and providing a shield part configured to contact an end portion at the end of the image support body in order to shield toner removed by the cleaning member from flowing out from the end of the image support body and bonding to an image transfer medium, wherein said predetermined width satisfies that relationship $A+B \leqq C$, where A is a width of the area of the charging member that is maintained at a gap distance from an area of the image support body, B is a total width of said spacer and C is said predetermined width of the cleaning member; and providing a charging member cleaning part adjacent to said charging member and configured to clean a surface of the charging member, wherein the charging member cleaning part has a width F which satisfies the relationship $A+B \leqq F$.

* * * * *

UNITED STATES PATENT AND TRADEMARK OFFICE

CERTIFICATE OF CORRECTION

PATENT NO. : 7,539,451 B2
APPLICATION NO. : 11/223923
DATED : May 26, 2009
INVENTOR(S) : Kawasumi et al.

It is certified that error appears in the above-identified patent and that said Letters Patent is hereby corrected as shown below:

On the title page, Item (75), the Inventors' information is incorrect. Item (75) should read:

-- (75) Inventors: Masanori Kawasumi, Yokohama (JP); Haruji Mizuishi, Oota-ku (JP); Tokuya Ojimi, Kawasaki (JP); Toshio Koike, Kawasaki (JP); Takeshi Shintani, Kawasaki (JP); Yuji Arai, Kawasaki (JP); Takuzi Yoneda Oota-ku (JP); Ken Amemiya, Nerima-ku (JP); Takaaki Tawada, Yokohama (JP); Masami Tomita, Numazu (JP); Takeshi Uchitani, Kamakura (JP); Nobuo Kuwahara, Yokohama (JP); Hiroyuki Nagashima, Yokohama (JP); Masato Yanagida, Meguro-ku (JP) --

Signed and Sealed this

Fourteenth Day of July, 2009

John Doll

JOHN DOLL
*Acting Director of the United States Patent and Trademark Office*